US006598419B1

(12) United States Patent
Tago

(10) Patent No.: US 6,598,419 B1
(45) Date of Patent: Jul. 29, 2003

(54) STOREHOUSE OF LIQUOR

(75) Inventor: Masafumi Tago, Tokyo (JP)

(73) Assignee: Nippon Biso Service, Inc., Tokyo (JP)

( * ) Notice: Subject to any disclaimer, the term of this patent is extended or adjusted under 35 U.S.C. 154(b) by 0 days.

(21) Appl. No.: 10/243,847

(22) Filed: Sep. 16, 2002

(30) Foreign Application Priority Data

Jul. 12, 2002 (JP) ..... 2002-203584

(51) Int. Cl.[7] ..... B01D 9/04; F25D 3/08

(52) U.S. Cl. ..... 62/457.5; 62/529; 62/457.3; 62/457.7; 62/457.9; 62/457.4

(58) Field of Search ..... 62/457.5, 457.3, 62/529, 457.7, 457.9, 457.4, 457.1

(56) References Cited

U.S. PATENT DOCUMENTS 4,286,440 A * 9/1981 Taylor ..... 62/457
4,344,300 A * 8/1982 Taylor ..... 62/457
4,554,798 A * 11/1985 D'Amour et al. ..... 62/457
4,607,502 A * 8/1986 Tomac ..... 62/294
4,819,793 A * 4/1989 Willard et al. ..... 206/162
5,215,208 A * 6/1993 Jackson ..... 220/516
6,065,303 A * 5/2000 Harris ..... 62/457.5
6,360,558 B1 * 3/2002 Woog ..... 62/457.5

* cited by examiner

*Primary Examiner*—William C. Doerrler
*Assistant Examiner*—Mark Shulman
(74) *Attorney, Agent, or Firm*—Sughrue Mion, PLLC

(57) ABSTRACT

To provide an economical storehouse of liquor with little temperature change if possible at a low price.

A storehouse 1 of liquor having heat insulation housings which consist of polystyrene foam is provided, comprising;

a cold-preserving agent accommodation part 10*a* capable of having cold-preserving agents 15 which can be exchanged, liquor storage parts 11*a*, 12*a*, 13*a*, and 14*a* capable of accommodating a bottle of liquor, and an air hole for communicating said cold-preserving agents accommodation part 10*a* to said liquor storage parts 11*a*, 12*a*, 13*a*, and 14*a*.

14 Claims, 7 Drawing Sheets

STOREHOUSE OF LIQUOR

TECHNICAL FIELD OF THE INVENTION

The invention relates to a storehouse of liquor for storing liquor included in the bottle and the like, and specifically, a storehouse of liquor in which the temperature suitable for storage of a bottle can be maintained economically.

DESCRIPTION OF RELATED ARTS

In recent years, according to the gourmet boom, those who drink wine in Japan have been increasing rapidly. Along with this, those who show a prejudice to the taste and aroma of wine also increase rapidly, and the perfect time to drink of wine is also a matter of concern. Generally, quality changes with the harvest ground of a grape, which is a material of wine, and harvest years. It is said that there is time of "the perfect time to drink" in wine, respectively. Many of the wine made from the grape blessed with conditions, such as the weather, demonstrate the true delicacy, after making it ripe for a long period of time. Conversely, for the wine which was not blessed with above conditions "the perfect time to drink" of wine comes early while comparatively early growth. Therefore, quality comes to deteriorate after that.

Thus, true delicacy of wine can be tasted by making it ripe to some extent according to the wine. For maturity, wine has to be kept under the condition of fixed temperature, humidity, etc, which is the environment suitable for wine. For this reason, the wine cellar is used as an equipment which keeps wine.

Generally, it is especially supposed temperature is most critical among four factors for preservation of wine, which are temperature, humidity, light, and vibration. Referring to the temperature for preservation, it is said that to lessen temperature change is rather important than at what degree temperature is set. Hence, if the temperature changes exceeding two to three degrees in a day, problem is involved therein.

Therefore, a wine cellar can be uniformly maintained to a favorite temperature. There are various types of wine cellars used by an individual, a restaurant, wine manufactures/selling contractors, etc. However, in order for an individual especially to keep wine, the wine cellar of the following types is used.

As the first conventional wine cellar, there is a small refrigerator type currently manufactured and sold for an individual and homes. However, there arises a problem that a refrigerator type is a large sum for purchasing individually and electric cost also starts highly. Moreover, for maturity of wine, exposure to a continuous vibration is not desirable. Therefore, a problem is involved in a refrigerator type where a continuous vibration by the compressor is generated.

As the second conventional wine cellar, there is a rental wine cellar of the special contractor who keeps individual wine. Although temperature and humidity are ideally set up since a special contractor keeps it, it also becomes a burden for an individual to pay the charge of a rental periodically. Further, there was also posed a problem that the desire of keeping wine at hand is not satisfied.

Then, the present invention is provided to solve the above-mentioned problem. That is, an economical storehouse of liquor with little temperature change is provided at a low price.

To solve above problem, the invention of claim 1 provides a storehouse of liquor having a heat insulation housing of polystyrene foam, the heat insulation housing comprising:

A cold-preserving agent accommodation part for storing the cold-preserving agent, a liquor storage part for storing bottles of liquor, and an air hole for communicating the cold-preserving agent storage part to the liquor storage part.

According to claim 1, a cold-preserving agent generates a cold air. The cold air goes into a liquor storage part via an air hole. Then, a bottle of liquor is cooled. Therefore, the bottle of liquor does not touch the cold-preserving agent directly, and since it is cooled through cold air, the bottle of a liquor storage part can be cooled at a comparatively uniform temperature. Then, suitable mature liquor without problems such as continuous vibration is achieved by no use of a compressor. Further, simple constitution permits cost to be reduced for manufacturing at a low price.

The invention of claim 2 according to the constitution described in claim 1 is characterized in that:

a liquor storage part consists of a bottle storage part with plurality of layers, and the bottle storage part of respective adjoining layer is communicated through an air hole.

According to claim 2, in addition to the manner of claim 1, since a bottle storage part having plurality of layers is communicated through an air hole, cold air by a cold-preserving agent spreads round the bottle storage part of each layer through this air hole. Therefore, the whole area in the heat insulation housing can be maintained at a fixed temperature. Thereby, each layer can accommodate a bottle of liquor. This contributes to having as many bottles as possible kept therein.

The invention of claim 3, according to the constitution described in claim 2, is characterized in that:

heat insulation housings are separable at the bottle storage part of each layer, wherein the heat insulation housings are formed in the same profile such that one heat insulation housing is fittingly engageable with another heat insulation housing.

According to claim 3, in addition to the manner described in claim 2, heat insulation parts are separable at a bottle storage part of each layer. With this arrangement, respective layer in agreement with a number of a bottle to be stored can be combined to form a storehouse having the required number of layers. Therefore, a storage space and the like can be made into necessary minimum.

The invention of claim 4, according to claim 1, is characterized in that:

a cold-preserving agent accommodation part is located above a liquor storage part.

According to claim 4, in addition to the manner described in claim 1, since a cold-preserving agent part is located above a heat insulation housing, the cold-preserving agent can be renewed easily. Also, since the cold-preserving agent accommodation part is located above a liquor storage part, cold air by the cold-preserving agent gets down to the liquor storage part via an air hole to allow the cold air to spread round the whole storage part.

The invention of claim 5, according to claim 1, is characterized in that:

a liquor storage part has an inner surface formed substantially corresponding to a bottle to be stored.

According to claim 5, in addition to the manner described in claim 1, inner surface of a liquor storage part is formed substantially corresponding to a bottle to be stored. Therefore, a bottle placed in the liquor storage part is hard to roll and can be held stably. Thus, unexpected rolling of a bottle resulting in breakage can be prevented.

The invention of claim 6, according to claim 5, is characterized in that:

inner surface of a liquor storage part is provided with a projection which allows a bottle to be placed in a predetermined spaced relationship to the inner surface thereof.

According to claim 6, in addition to the manner described in claim 5, since inner surface of the liquor storage part is provided with a projection, complete adhesion to the part in which a bottle is placed is obviated. Therefore, when air passes through the circumference of a bottle, the whole bottle can be maintained at a fixed temperature while cold air flows the surroundings of the bottle.

The invention of claim 7 provides a storehouse of liquor, wherein, heat insulation housings according to claim 1 are accommodated in a carton box.

According to claim 7, in addition to the manner described in claim 1, heat insulation housings are accommodated in a carton box having a heat insulation effect. Therefore, the heat insulation effect can be heightened. Further, even when a bottle storage part consists of plurality of layers, they can be collected into one and is convenient to carry.

DESCRIPTION OF THE PREFERRED EMBODIMENTS

Figure 1:
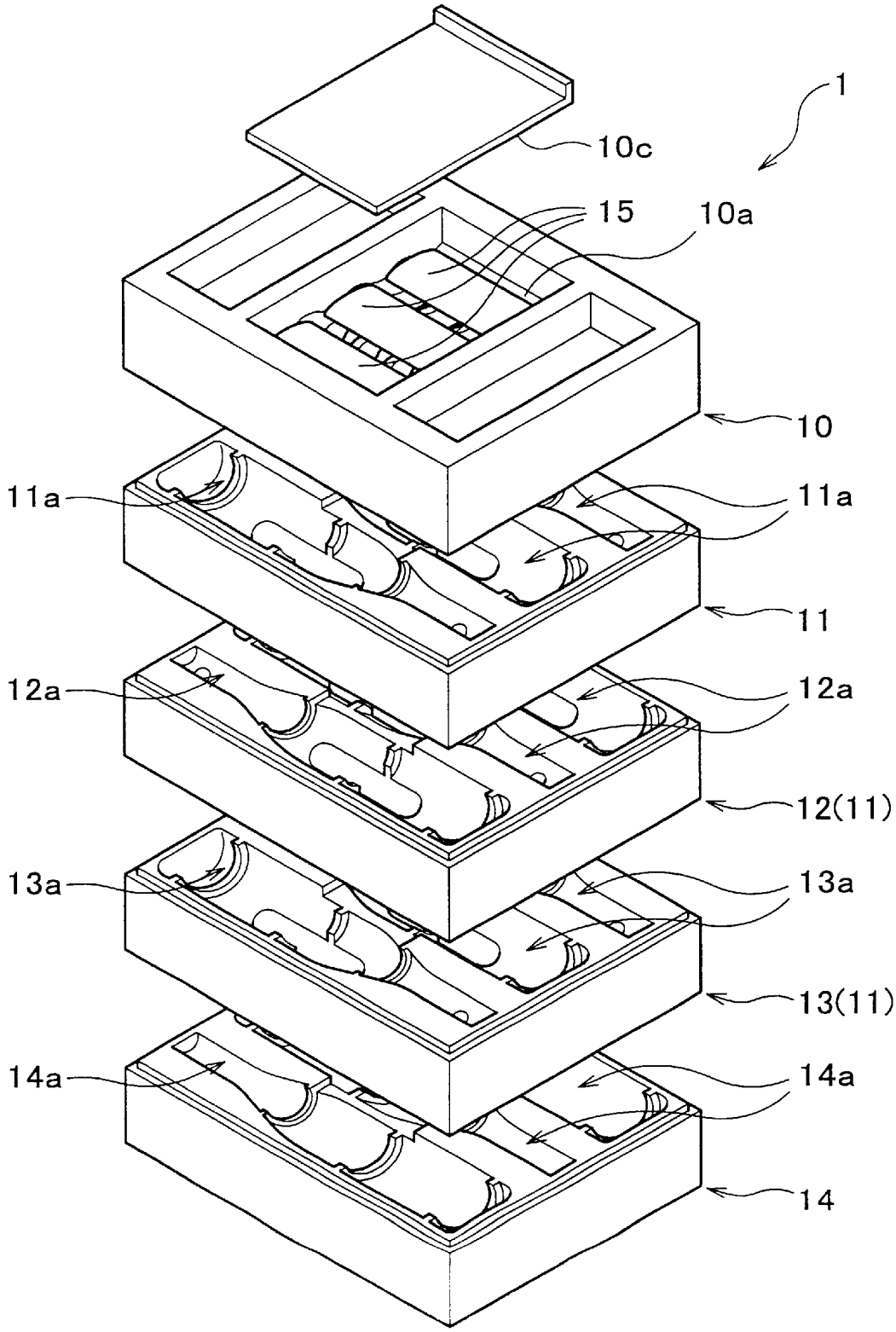
FIG. 1 is an exploded perspective view depicting the constitution of a wine cellar according to one aspect of the embodiment of the invention.
Figure 2B:
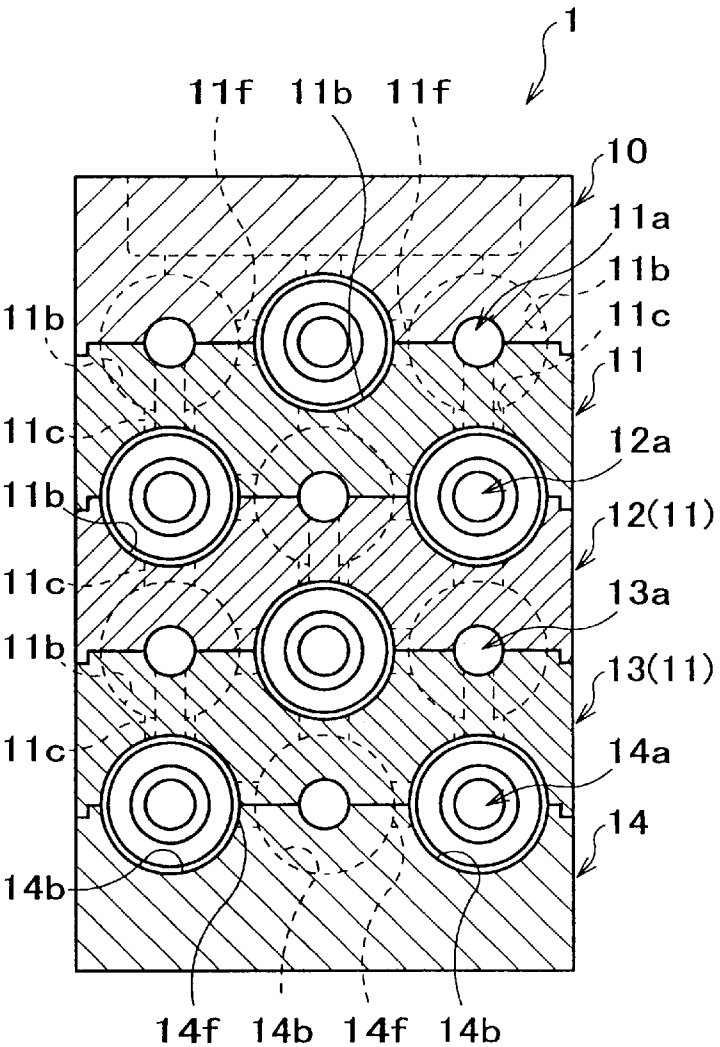
FIG. 2B is a sectional view taken along the line A—A of FIG. 2A.
Figure 2A:
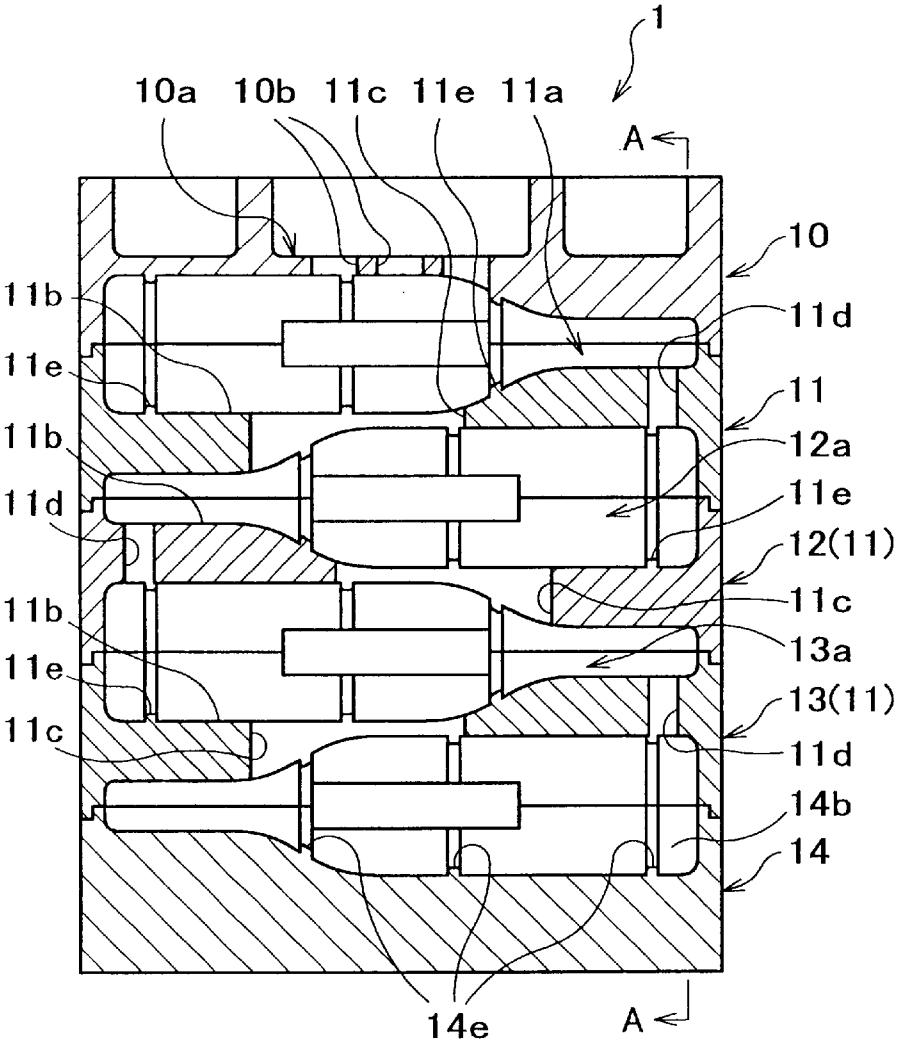
FIG. 2A is a sectional view according to the embodiment of the invention.

As one aspect of a storehouse of liquor in the present invention, the example of the wine cellar in which a wine bottle containing wine is stored will be now described referring to the drawings. FIG. 1 is an exploded perspective view showing the constitution of the wine cellar according to the embodiment of the invention. FIG. 2A is a sectional view describing the wine cellar according to the embodiment of the invention, and FIG. 2B is a sectional view taken along the line A—A of A.

A wine cellar 1 according to the embodiment is provided with a cold-preserving agent accommodation box 10 having the cold-preserving agent accommodation part 10*a*, an upper block 11 which forms a liquor storage part, a first middle block 12, a second middle block 13 and a lower block 14 to be separated respectively.

A bottle storage part (a liquor storage part) 11*a* is made into a space for storing a wine bottle in the upper block 11 substantially in agreement with a form of the wine bottle in a manner that three bottle storage parts are transversly laid in a row. In the same way, the bottle storage parts 12*a*, 13*a*, and 14*a* are formed in the first middle block 12, the second middle block 13, and the lower block 14 respectively.

Incidentally, foaming styrene resin is preferably employed for a cold-preserving agent accommodation box 10 and for the materials of the respective block 11, 12, 13, and 14.

Figure 3B:
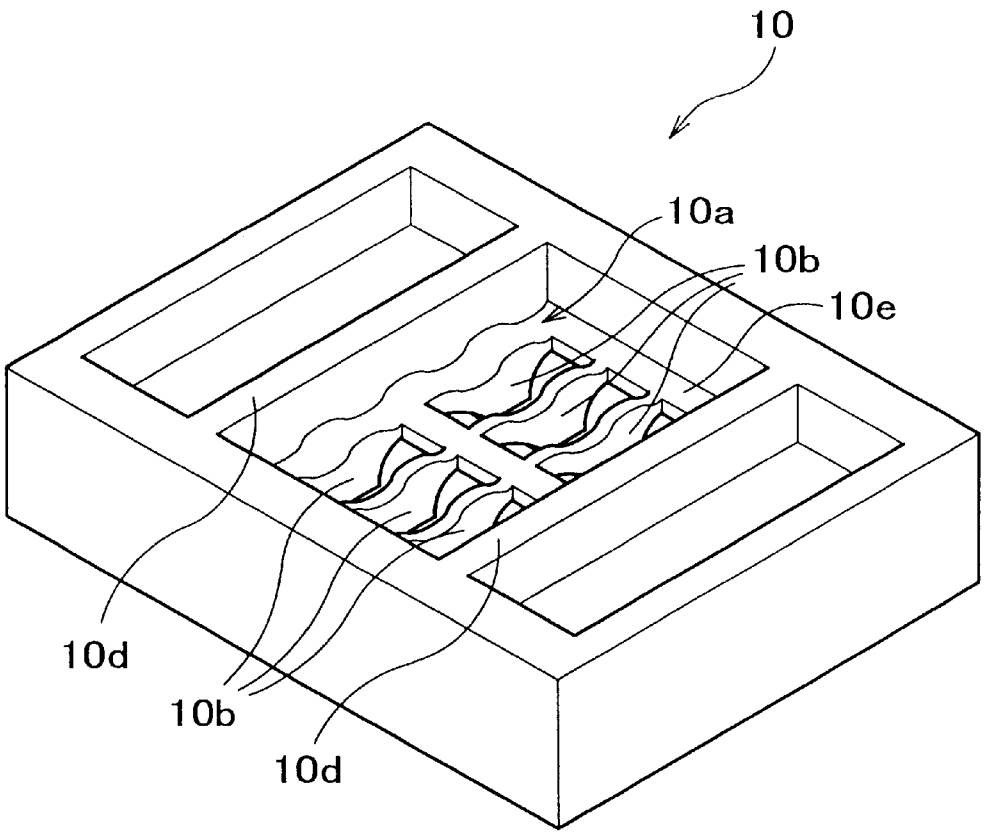
FIG. 3B is a perspective view of a cold-preserving agents accommodation box.
Figure 3A:
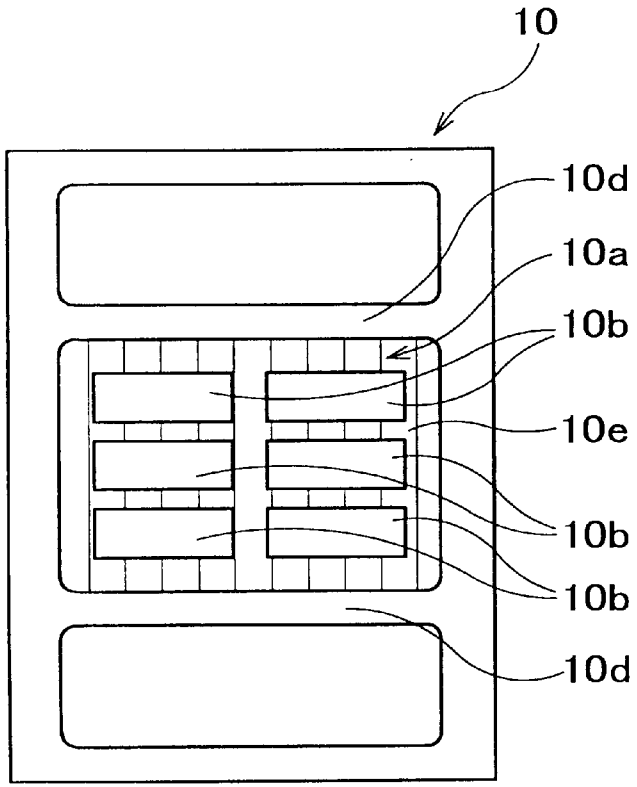
FIG. 3A is a plan view of a cold-preserving agents accommodation box.

FIG. 3A is a plan view of a cold-preserving agents accommodation box 10, and FIG. 3B is a perspective view of a cold-preserving agents accommodation box 10. The cold-preserving agents accommodation box 10 is adapted to accommodate cold-preserving agents 15.

A cold-preserving agents accommodation box 10 is made into the quadrangle box as shown in FIG. 3A. The cold-preserving agents accommodation box 10, inside of which is divided into three by barrier plates 10*d*, 10*d*, is intended to accommodate cold-preserving agents 15 ( see FIG. 1) in a cold-preserving agents accommodation part 10*a* defining the section located centrally thereof. Six rectangular air holes 10*b*, three rows in the centrally vertical direction and two lines in right and left in total are formed on the cold-preserving agents accommodation part 10*a* and adapted to communicate to a bottle storage part 11*a* of an upper block 11 placed under the cold-preserving agents accommodation box 10 (see FIG. 2 (*a*) and FIG. 3 (*a*)).

Incidentally, the placement side 10*e* of cold-preserving agents 15 of a cold-preserving agents accommodation part 10*a* is preferably formed to have a waved surface. Consequently, the contact area between the placement side 10*e* and the cold-preserving agents 15 placed becomes narrow. Then, a generation of cold air can be urged more efficiently.

When wine is kept after accommodating cold-preserving agents 15, a cold-preserving agents accommodation part 10*a* is covered by a lid 10*c* of the size in agreement with its form. As materials for the lid 10*c*, polystyrene foam, such as foaming styrene resin, is used. Thereby, the heat insulation effect of a wine cellar 1 can be heightened.

Moreover, the surface form (inner surface) in agreement with the form of a wine bottle placed in a bottle storage part 11*a* of an upper block 11 is formed in the surface (undersurface) as opposed to the upper block 11 of a cold-preserving agents accommodation box 10. However, this form does not necessarily need to be completely in agreement with the form of a wine bottle. As long as the gap is formed between a cold-preserving agents accommodation box 10 and the upper block 11 so as to obviate the situation obstructive to the wine bottle to be stored, it does not matter what form it takes.

Figure 4B:
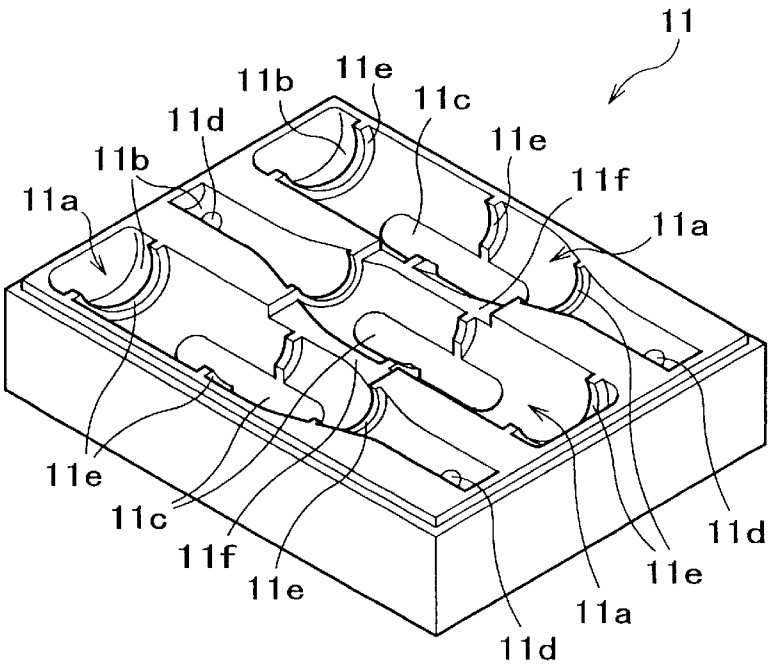
FIG. 4A is a plan view of an upper block, FIG. 4(*b*) is a sectional view of the upper block, and FIG. 4(*c*) is a sectional view of the upper block.
Figure 4A:
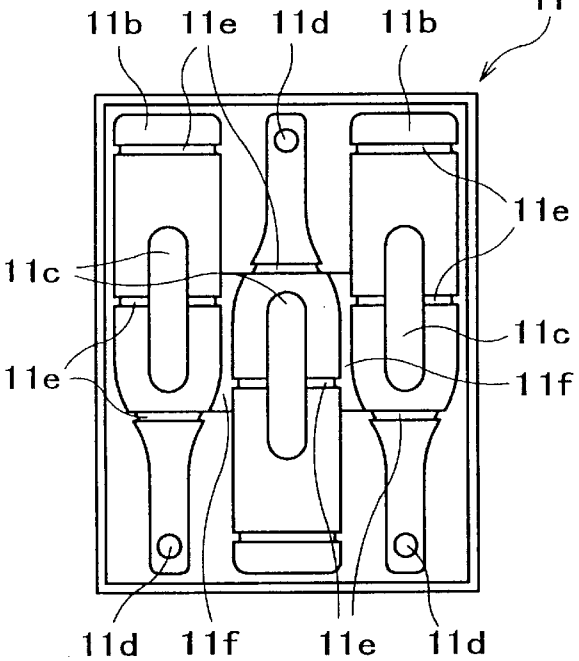
Figure 4C:
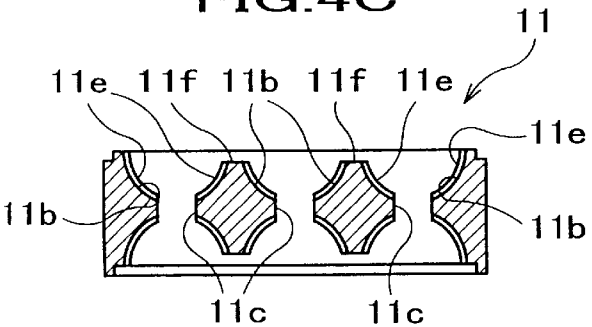

FIG. 4A is a plan view of an upper block, FIG. 4B is a perspective view of the upper block, and FIG. 4C is a sectional view of the upper block.

An upper block 11 is arranged under a cold-preserving agents accommodation box 10, having a bottle storage part 11*a* where a bottle can be placed.

A bottle storage part 11*a* is provided a bottle placement surface 11*b* for placing a bottle directly and an air hole 11*f* for circulating cold air between adjoining bottle placement side 11*b* respectively.

Inner surface of a bottle placement side 11*b* is made into the surface form in agreement with the form of a wine bottle to be placed so as to be laid with the upper and lower sides of an adjoining bottle arranged alternately. Cavity portion of the form of a wine bottle is made by defining the surface form which was formed in the undersurface of the above cold-preserving agents accommodation box 10 and the surface form of the bottle placement side 11*b* as one pair.

A bottle placement side 11*b* is provided with air holes 11*c* and lid for circulation of cold air between the first middle blocks 12 and a rib (projection) lie which allows a bottle to be placed in spaced relationship so that it may not be directly close to the bottle placement side 11*b*.

Air holes 11*c* and 11*d* are formed so that communication from a bottle placement side 11*b* to a bottle storage part 12*a* of the first middle block 12 may be achieved.

An air hole 11*c* is located in the central part of the form of the wine bottle to be placed, and is somewhat smaller than the size of the trunk portion of a wine bottle.

Air hole 11*d* is located in the vicinity of the pouring mouth in the form of a wine bottle, and for example, is made in circle form with a radius of about 1cm. (see FIG. 2 (*a*)).

A rib 11*e* is prepared in the upper part of the trunk portion of a wine bottle, the lower part, and corresponding central portion thereof along the circumference of a bottle, respectively, so as to allow the wine bottle to be placed in a predetermined spaced relationship to a bottle placement side 11*b*. Thereby, better circulation of cold air in the circumference of a bottle can be achieved.

An air hole 11*f* is formed between bottle placement sides 11*b* so as to circulate cold air between adjoining bottle storage parts 11*a*. The air hole 11*f* is formed for the communication to the trunk portion of a wine bottle in the adjoining bottle placement side 11*b* to be achieved, as shown in FIG. 4A, 4B and 4C. Also, the air hole has a width of substantially half of a trunk portion and a depth of about 1cm, for example from the upper surface of the bottle storage part 11*a*.

In addition, the surface form which is made in agreement with the form of a bottle to be placed in the first middle block 12 is formed on the field of a upper block 11 as opposed to the first middle block 12.

Components similar to those previously described with reference to the first middle block 12 arranged under an upper block 11 and the second middle block 13 arranged under the first middle block 12, are denoted by the same or similar reference numerals in the drawings and will not be discussed again.

Incidentally, when making a combination of the respective block 11, 12, and 13, the orientation of a wine bottle to be placed in each block 12 and 13 and the orientation of the wine bottle to be placed in a bottle placement side 11*b* and 12*b* of the block 11 and 12 which is just above each block 12 and 13 are made for the upper and lower sides thereof to become reverse.

Figure 5:
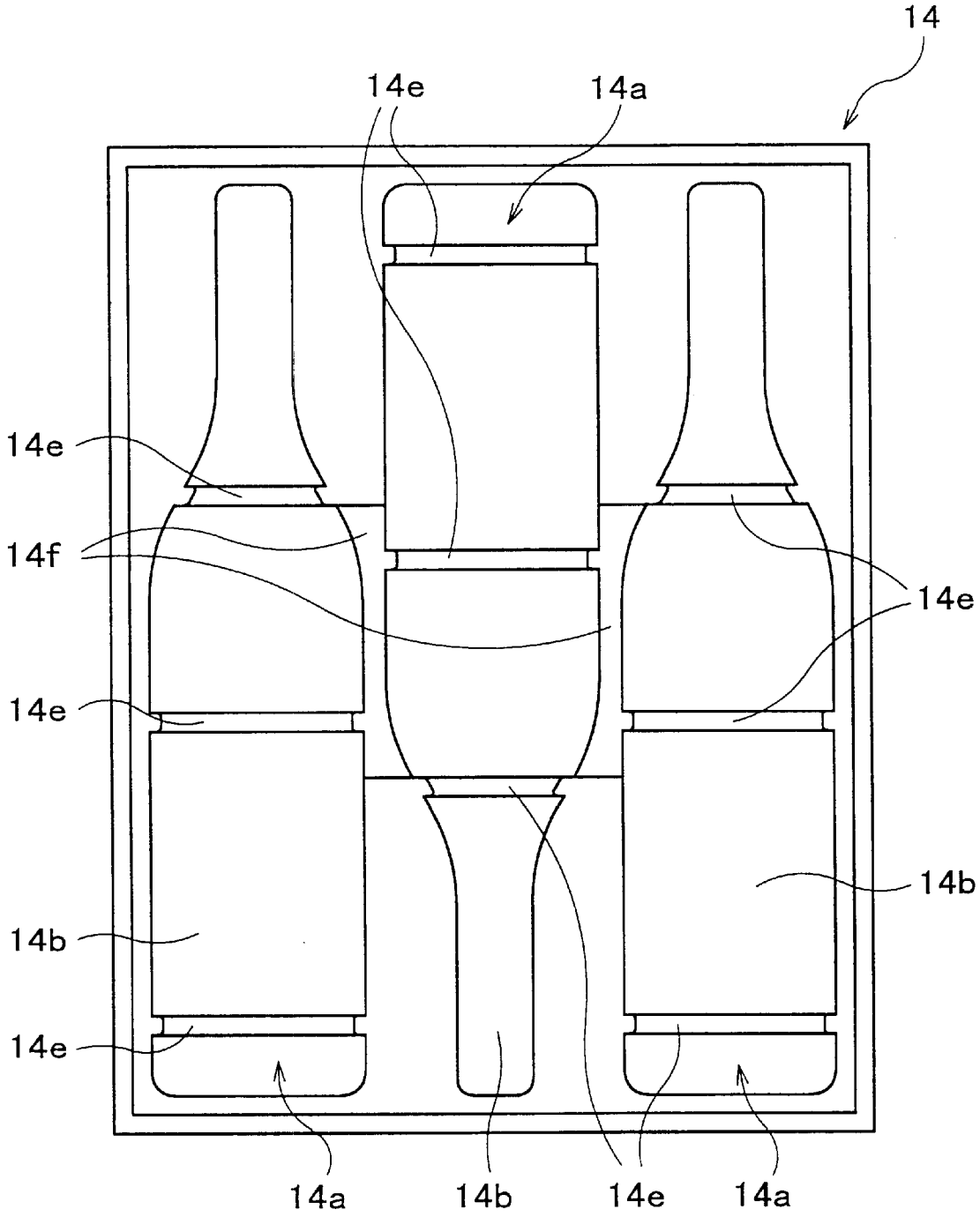
FIG. 5 is a plan view of a lower block.

FIG. 5 is a plan view of the lower block. Incidentally, lower block 14 is a partially modified construction of the upper block 11. Therefore, components similar to those previously described will not be discussed again.

Lower block 14 is arranged under the second middle block 13 as shown in FIG. 14 and constitutes the lowest stage of the wine cellar according to the embodiment of the invention.

As shown in FIG. 5, lower block 14 comprises a bottle storage part 14*a* having three bottle placement sides 14*b* and an air hole 14*f* similarly to the upper block 11, in which the bottle placement side 14*b* has a rib 14*e*. Since the lower block 14 is the lowest stage of a wine cellar, it is not necessary to form the air hole connected to the lower stage further.

Incidentally, each block 11, 12, 13, and 14 is made into a square box type similarly to a cold-preserving agents accommodation box 10. And the edge of the upper and lower sides is intended to be fittingly engaged respectively.

Figure 6:
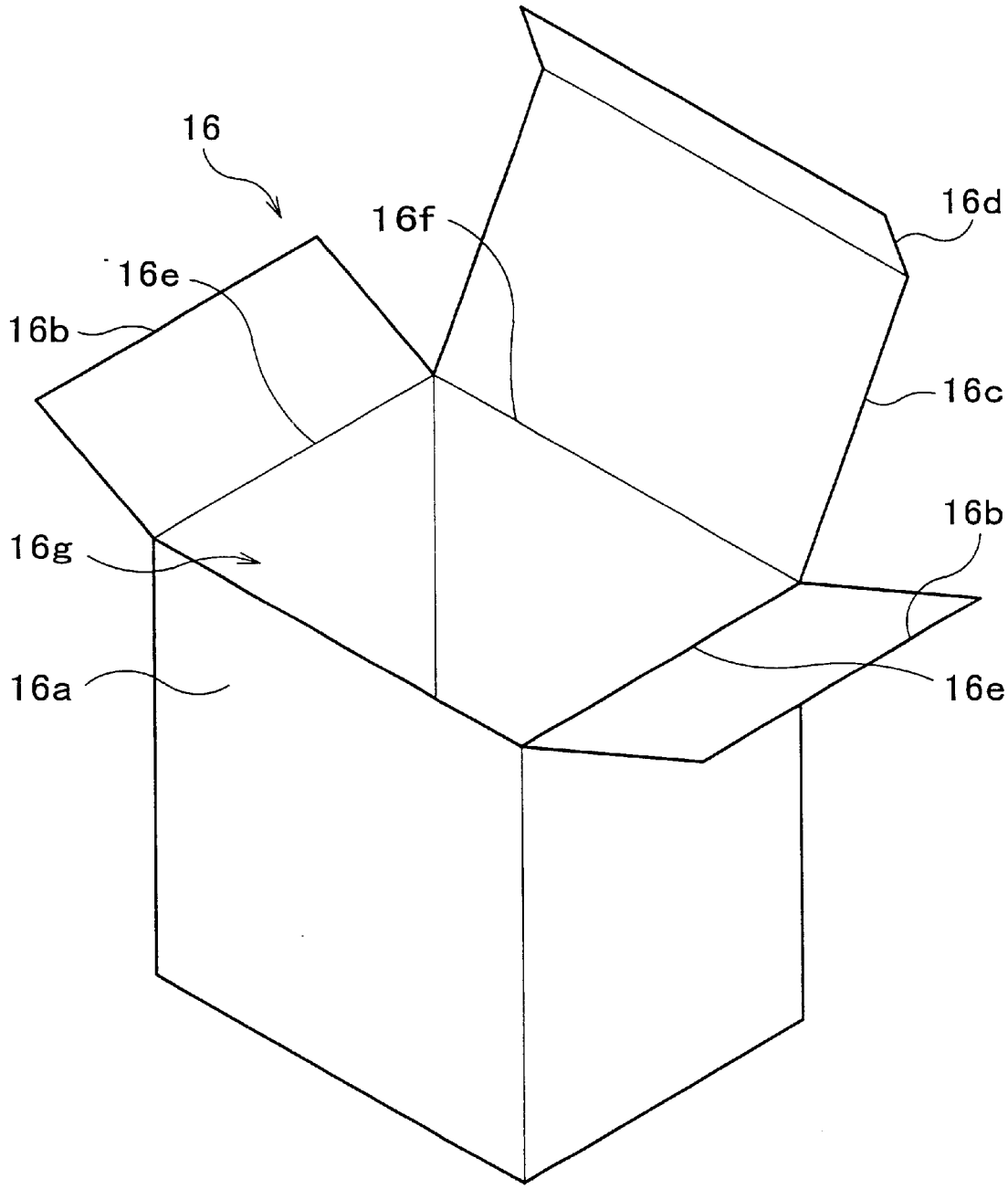
FIG. 6 is a perspective view of a carton box.

When wine is actually kept to this wine cellar 1, it is desirable to put a wine cellar 1 into a carton box of exclusive use. A perspective view of the carton box (a storehouse of liquor) is shown in FIG. 6. As shown in FIG. 6, the carton box 16 comprises a box type main part 16*a* which has openings 16*g* in the upper part, lids 16*b* and 16*b* which can be turned up from the edges 16*e* and 16*e* where right and left of the openings 16*g* opposes, and one-sheet lid 16*c* which covers the whole openings 16*g* from edges 16*f* interposed between the edges 16*e* and 16*e* on either side. Tip part 16*d* of one-sheet lid 16*c* is adapted to be inserted into the inside of openings 16*g*, when covering openings 16*g*. With this arrangement, the gap made at the time of covering openings 16*g* of main part 16*a* of a carton box 16 with lids 16*b* and 16*c* can be lessened. Whereby, a carton box 16 and a wine cellar 1 can raise the heat insulation effect in a wine cellar further. Moreover, since the wine cellar 1 does not dissociate in case it carries, it is easy to carry.

Hereafter, the case where wine is kept in a wine cellar 1 according to the embodiment of the invention will be discussed. The commercially available cold-preserving agents 15 of 160 g is arranged in a manner that it may not overlap with the cold-preserving agents accommodation part 10*a* of the cold-preserving agents accommodation box 10 with defining three as one set. Then, wine bottle is kept in the bottle storage parts 11*a*, 12*a*, 13*a*, and 14*a*. Thereby, the inside of the wine cellar 1 can be maintained at a certain time in a certain temperature range, and wine can be preserved good. Also, wine can be preserved in a certain temperature range over a long period of time by exchanging cold-preserving agents 15 periodically. It is desirable especially to exchange 2 to 3 times per day on a tropical day of summer, because it is also early that the effect of the cold-preserving agents 15 goes out on a tropical day when temperature is high. Since this wine cellar 1 consists of polystyrene foam and foaming styrene resin etc, which contribute to the reduction of cost, thereby improving productivity at a low price.

Also, bottle storage parts 11*a*, 12*a*, 13*a*, and 14*a* with plurality of layers are communicated to air holes 11*c* and 11*d*, which contributes to the effect that cold air by cold-preserving agents 15 spreads round each layer. Therefore, the whole part of the wine cellar 1 can be maintained in a certain temperature range. Accordingly, plurality of bottles can be kept. In addition, temperature change of each layer is suppressed in the range of around 2 degrees as hereinafter referred. Therefore, it is suitable for preservation of wine when no temperature change occurs, as much as possible.

Further, since a cold-preserving agents box 10 is located upwardly in the wine cellar 1, cold-preserving agents 15 can be renewed easily. Also, since the cold-preserving agents accommodation box 10 is above each block 11, 12, 13, and 14, cold air by the cold-preserving agents 15 can spread round each layer 11, 12, 13, and 14.

Since bottle placement sides 11*b* and 14*b* and the like take substantially the same form with a wine bottle to be stored, bottles placed in the bottle placement sides 11*b* and 14*b* etc. are hard to roll, and held stably. Therefore, unexpected rolling of the bottles resulting in breakage can be prevented. Since ribs 11*e* and 14*e* are provided in bottle placement sides 11*b* and 14*b*, complete adhesion to the field in which a bottle is placed is obviated. Therefore, cold air can pass through the circumference of the bottle. Thus, the cold air wraps the bottle to permits whole bottle to be maintained in a certain temperature range.

Since a cold-preserving agents box 10 and each block 11, 12, 13, and 14 are separably formed, a wine cellar 1 can be arranged by the combination of a bottle storage part in agreement with the number of the bottle to be stored. Thus, a storage space and the like can be made into necessary minimum.

As described above, a wine cellar 1 according to the embodiment of the invention was shown. However, the invention is not limited to the embodiment, and numerous variations and modifications will now occur.

Although a bottle storage part was constituted of four stages according to the embodiment, a bottle storage part, for example may be constituted of either less than four stages, or five or more stages. When preparing five or more stages, a cold-preserving agents accommodation box can also be increased along with this. Also, the bottle storage part was arranged to have three for each block. However how many is prepared can be changed suitably.

Further, a rib 11*e* is provided on a bottle placement side 11*b* according to the embodiment of the invention, the invention is not limited to the rib, but any form may be taken as long as it is a projection which defines predetermined spaced relationship to the bottle placement side 11*b*.

When assuming a wine cellar is accommodated in a carton box, the whole opening of a cold-preserving agents accommodation box 10 may be covered by a lid which turned up by right and left of corrugated paper, in addition to the lid 10*c* for heightening the heat insulation effect of cold-preserving agents accommodation part 10*a*. With this arrangement, the heat insulation effect can be heightened further. Also, it is needless to say that a bottle storage part, a bottle placement side, an air hole, and a size and form of the air hole can be changed suitably.

Figure 7:
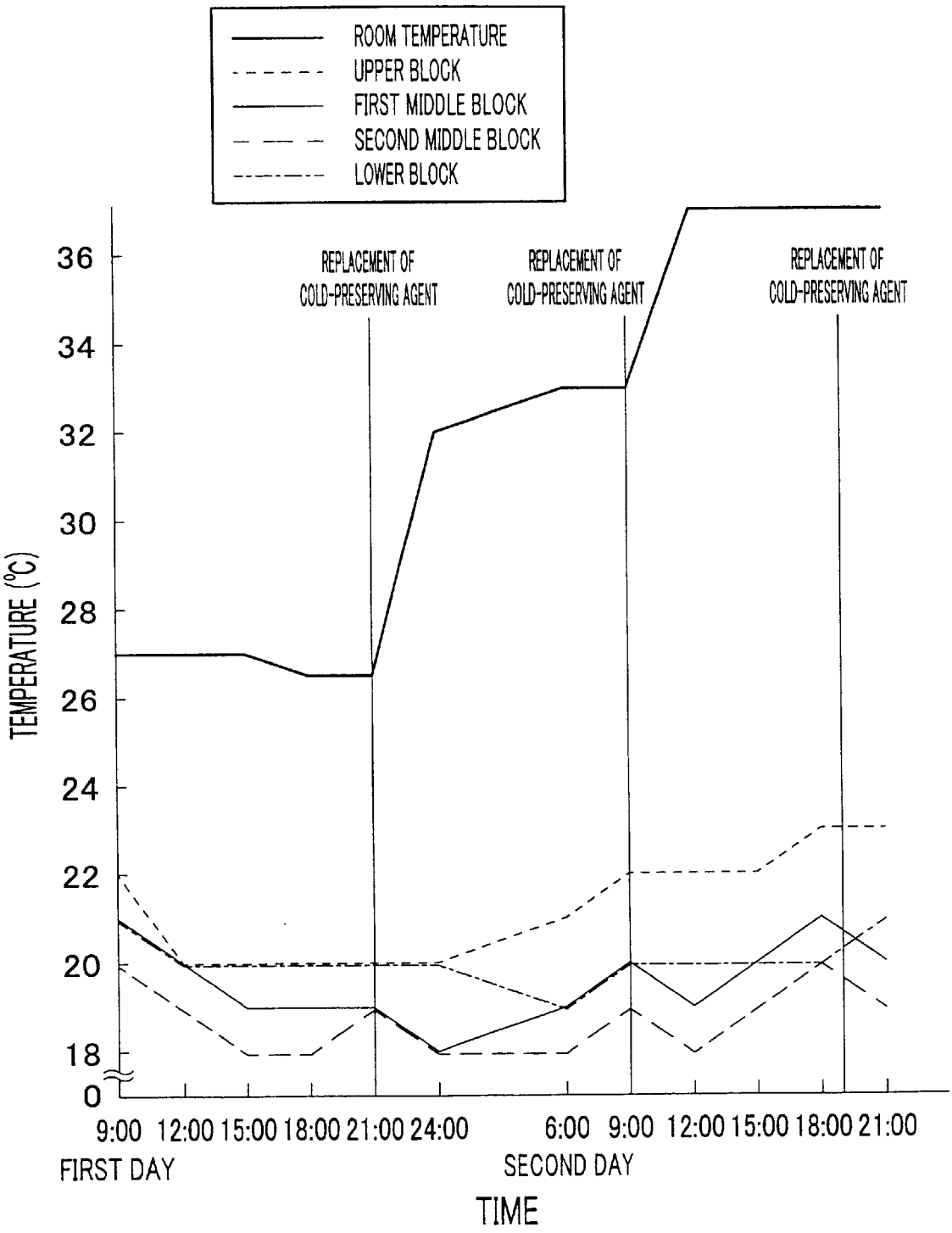
FIG. 7 is a graph of the measurement result of each block, when exchanging a cold-preserving agent every 12 hours.

Next, the measurement result of the temperature change in each block 11, 12, 13, and 14 at the time of actually accommodating cold-preserving agents 15 in a wine cellar 1 which consists of foaming styrene resin to preserve wine is shown in FIG. 7. This measurement is carried out with a temperature sensor prepared in air holes 11*d*, 11*d*, 11*d*, and 14*d* of each block 11, 12, 13, and 14.

FIG. 7 is the graph of the result of measuring the temperature of each block 11, 12, 13, and 14, wherein, three cold-preserving agents 15 are accommodated beforehand, then, exchanged every 12 hours for two days. The contents of the cold-preserving agents 15 to be used were super absorbent polymer, and the temperature of the cold-preserving agents 15 at the time of exchange was 0 degree.

First, as for temperature change of each block 11, 12, 13, and 14, in FIG. 7, it is elucidated that temperature is changing in the range of 20 degrees to 23 degrees in the upper block 11, 18 degrees to 21 degrees in the first middle block 12, 18 degrees to 20 degrees in the second middle block 13, and 19 degrees to 21 degrees in the lower block 14. Namely, the upper block 11 and the first middle block 12 are maintained within 3 degrees of temperature difference, and the second middle block 13 and the lower block 14 are maintained within 2 degrees of temperature difference.

Also, even when an indoor temperature will be raised rapidly at 21:00 on the first day, the temperature of blocks 11, 12, 13, and 14 seldom goes up compared with the rise of room temperature. Thereby, it was elucidated that temperature change can be suppressed.

Temperature change of 2 to 3 degrees or more in a day is not desirable in preservation of wine as described above. However, according to a wine cellar 1 of this invention, in the second middle block 13 and the lower block 14 if seen individually, the temperature change is suppressed in the range of 2 degrees or less. Therefore, it can be said that it is suitable for preservation of wine. Also, referring to the upper block 11, since it is after 18:00 of the second day when room temperature exceeded 35 degrees, it is possible to suppress the temperature change within the range of 2 degrees or less if time to exchange a keeping cool material is shortened or the like. Referring to the first middle block 12, temperature change is a little sharp compared with other blocks. However, since 21 degrees of the highest temperature was recorded at 9:00 and 18:00, on the first day and the second day respectively, if wine is kept in the first middle block 12 set to be in the cold state beforehand, temperature change is suppressed to minimum.

Accordingly, when performing exchange of cold-preserving agents 15 every 12 hours, in each blocks 11, 12, 13, and 14, it is elucidated that temperature change can be suppressed in the range of 2 degrees or less, and it is suitable for preservation of wine. Also, when room temperature exceeds 35 degrees or more, it is good to exchange the cold-preserving agents 15 more frequently.

What is claimed is:

1. A storehouse of liquor having heat insulation housings made of cellular plastic, comprising:

a cold-preserving agents accommodation part for storing-cold-preserving agents therein; a liquor storage part for storing bottles of liquor therein; and air holes for communicating the cold-preserving agents accommodation part to the liquor storage part.

2. A storehouse of liquor as set forth in claim 1, wherein the liquor storage part consists of a plurality of stacked bottle storage parts, and wherein each of the bottle storage parts is in communication with adjacently stacked bottle storage parts through air holes.

3. A storehouse of liquor as set forth in claim 2, wherein the heat insulation housings are separable at the bottle storage part of each layer, and wherein the heat insulation housings are formed in the same profile such that one heat insulation housing is fittingly engaged with another heat insulation housing.

4. A storehouse of liquor as set forth in claim 1, wherein the cold-preserving agents accommodation part is located above the liquor storage part.

5. A storehouse of liquor as set forth in claim 1, wherein the liquor storage part has an inner surface substantially corresponding to a bottle to be stored.

6. A storehouse of liquor as set forth in claim 5, wherein an inner surface of the liquor storage part includes a projection which allows a bottle to be set in a predetermined spaced relationship to the inner surface.

7. A storehouse of liquor as set forth in claim 1, wherein the heat insulation housings are accommodated in a carton box.

8. A storehouse of liquor comprising:

a housing;

a cold-preserving agents accommodation part, for storing cold-preserving agents therein, provided in the housing;

a liquor storage part, for storing bottles of liquor therein, provided in the housing; and an air hole provided in the housing and extending between the cold-preserving agents accommodation part and the liquor storage part, such that the air hole communicates the cold-preserving agents accommodation part to the liquor storage part.

9. A storehouse of liquor as set forth in claim 8, wherein the liquor storage part includes a plurality of stacked bottle storage parts, and wherein each of the bottle storage parts is in communication with adjacently stacked bottle storage parts.

10. A storehouse of liquor as set forth in claim 9, wherein the housing is separable at the bottle storage parts.

11. A storehouse of liquor as set forth in claim 8, wherein the cold-preserving agents accommodation part is located above the liquor storage part.

12. A storehouse of liquor as set forth in claim 8, wherein the liquor storage part has an inner surface substantially corresponding to a bottle to be stored.

13. A storehouse of liquor as set forth in claim 12, wherein an inner surface of the liquor storage part includes a projection which allows a bottle to be set in a predetermined spaced relationship to the inner surface.

14. A storehouse of liquor as set forth in claim 8, wherein the housing is accommodated in a carton box.

* * * * *